4/10/84 XR 4,441,760

United States Patent [19]

Hines

[11] 4,441,760

[45] Apr. 10, 1984

[54] METHOD FOR CLOSING A DRIFT BETWEEN ADJACENT IN SITU OIL SHALE RETORTS

[75] Inventor: Alex E. Hines, Grand Junction, Colo.

[73] Assignee: Occidental Oil Shale, Inc., Grand Junction, Colo.

[21] Appl. No.: 336,914

[22] Filed: Jan. 4, 1982

[51] Int. Cl.[3] ..... E21B 43/243

[52] U.S. Cl. ..... 299/2; 299/11; 299/13

[58] Field of Search ..... 299/2, 11, 13, 19; 166/259, 299, 247

[56] References Cited

U.S. PATENT DOCUMENTS

| | | | |
|---|---|---|---|
| 3,465,819 | 9/1969 | Dixon | 166/247 |
| 3,478,825 | 11/1969 | Closmann | 166/247 |
| 3,500,934 | 3/1970 | Magnuson | 169/2 |
| 3,532,528 | 11/1970 | Herce | 166/247 |
| 3,583,165 | 6/1971 | West | 61/35 |
| 3,620,301 | 11/1971 | Nichols | 166/247 |
| 3,817,039 | 6/1974 | Stewart et al. | 61/35 |
| 3,927,719 | 12/1975 | Maser | 169/46 |
| 3,950,029 | 4/1976 | Timmins | 299/2 |
| 4,017,119 | 4/1977 | Lewis | 299/2 |
| 4,044,563 | 8/1977 | Hurst et al. | 61/35 |
| 4,096,912 | 6/1978 | Lewis et al. | 166/259 |
| 4,131,416 | 12/1978 | Watson et al. | 299/11 |
| 4,133,580 | 1/1979 | French | 299/11 |
| 4,201,419 | 5/1980 | Hutchins | 299/2 |
| 4,239,284 | 12/1980 | Ridley et al. | 299/13 |
| 4,272,127 | 6/1981 | Hutchins et al. | 299/13 |
| 4,315,657 | 2/1982 | Burton | 299/2 |

FOREIGN PATENT DOCUMENTS 682981 11/1952 United Kingdom .

OTHER PUBLICATIONS

"Low Pressure Pneumatic Pipe Line Conveying . . . ", by Radmark.

*Primary Examiner*—Stephen J. Novosad
*Assistant Examiner*—William P. Neuder
*Attorney, Agent, or Firm*—Christie, Parker & Hale

[57] ABSTRACT

A row of horizontally spaced-apart in situ oil shale retorts is formed in a subterranean formation containing oil shale. Each row of retorts is formed by excavating development drifts at different elevations through opposite side boundaries of a plurality of retorts in the row of retorts. Each retort is formed by explosively expanding formation toward one or more voids within the boundaries of the retort site to form a fragmented permeable mass of formation particles containing oil shale in each retort. Following formation of each retort, the retort development drifts on the advancing side of the retort are closed off by covering formation particles within the development drift with a layer of crushed oil shale particles having a particle size smaller than the average particle size of oil shale particles in the adjacent retort. In one embodiment, the crushed oil shale particles are pneumatically loaded into the development drift to pack the particles tightly all the way to the top of the drift and throughout the entire cross section of the drift. The closure between adjacent retorts provided by the finely divided oil shale provides sufficient resistance to gas flow through the development drift to effectively inhibit gas flow through the drift during subsequent retorting operations.

35 Claims, 3 Drawing Figures

METHOD FOR CLOSING A DRIFT BETWEEN ADJACENT IN SITU OIL SHALE RETORTS

BACKGROUND OF THE INVENTION

1. Field of the Invention

This invention relates to in situ recovery of shale oil, and more particularly to techniques for closing a drift between adjacent in situ oil shale retorts to minimize gas flow through such drifts during retorting operations.

2. Description of the Prior Art

The presence of large deposits of oil shale in the semi-arid high plateau region of the Western United States has given rise to extensive efforts to develop methods for recovering shale oil from kerogen in the oil shale deposits. The term "oil shale" as used in the industry is, in fact, a misnomer; oil shale is neither shale, nor does it contain oil. It is a sedimentary formation comprising marlstone deposit with layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; 4,043,598; and 4,192,554, which are incorporated herein by this reference. These patents describe in situ recovery of liquid and gaseous hydrocarbon materials from a subterranean formation containing oil shale, wherein such formation is explosively expanded for forming a fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone through the fragmented mass. In the combustion zone, oxygen from the retort inlet mixture is depleted by reaction with the hot carbonaceous material to produce heat, combustion gas, and combusted oil shale. By continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, and a residual solid carbonaceous material.

The liquid products and the gaseous products are cooled by the cooler oil shale fragments in the retort on the advancing side of the retorting zone. The liquid hydrocarbon products, together with water produced in, or added to, the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

In carrying out retorting operations, it can be desirable to isolate adjacent in situ retorts from one another so that operations in one retort do not affect operations in adjacent retorts.

When forming a group or cluster of in situ retorts, vertical partitions or barriers of unfragmented formation are left between adjacent fragmented masses in the group of retorts. The partitions or barriers between individual retorts serve as gas barriers which isolate adjacent retorts, making it possible to independently control retorting operations in each fragmented mass within the group of retorts. The gas barriers also inhibit leakage of off gas into adjacent underground workings where operating personnel may be present.

When preparing a system of in situ oil shale retorts, it can be desirable to excavate retort development drifts through unfragmented formation between adjacent retort sites. Such drifting between adjacent retorts can be useful to provide access to excavate void spaces at different levels within each retort site, to drill blasting holes downwardly into the retort volume, and otherwise to assist in preparation of the retorts. It is also desirable to minimize gas flow through such development drifts interconnecting adjacent retorts so that during retorting operations, there is minimal fluid communication and disruption of retorting operations in either of the retorts.

A gas seal can be provided in development drifts interconnecting retorts for isolating retorting operations in adjacent retorts from one another. U.S. Pat. No. 4,133,580 to French discloses a method of forming a gas-impermeable seal in a drift between adjacent retorts. The gas seal includes an impervious layer of concrete or impervious clay a foot or so thick closing off the drift.

There is a need to provide an effective and inexpensive method for inhibiting gas flow through a drift between adjacent retorts. In an oil shale tract containing a large number of retorts, the number of retort development drifts between adjacent retorts can be considerable. There can be a number of such drifts excavated on each of several levels along each of many rows of retorts within the oil shale tract. Owing to the large number of gas seals required for such a tract of oil shale retorts, the system for sealing between retorts should not only be reasonably inexpensive, but also should not require an inordinate amount of additional effort or time as the retort system is being developed.

SUMMARY OF THE INVENTION

This invention provides a method for isolating in situ oil shale retorts in a subterranean formation containing oil shale. Such in situ retorts each contain a fragmented permeable mass of formation particles containing oil shale. The method comprises the steps of excavating at least one void within the boundaries of a first retort site, leaving at least one zone of unfragmented formation within the boundaries of the first retort site. A retort development drift is excavated from such a void to a location within the boundaries of a second in situ retort being formed adjacent the first retort site. Such a zone of unfragmented formation is explosively expanded toward the void within the first retort site to form a first in situ retort containing a fragmented permeable mass of formation particles containing oil shale, leaving a mass of such formation particles containing oil shale in the retort development drift. The retort development drift is closed off by compacting a mass of crushed oil shale particles into the development drift adjacent the formation particles present in the drift. The crushed oil shale particles have a substantially smaller average particle size than the average particle size of the oil shale particles in the first retort. Preferably, the particles are packed into the drift with a lower average void fraction than the average void fraction of the fragmented mass in an adjacent retort. The compact mass of oil shale particles provides a closure in the drift having a greater resistance to gas flow than the relatively larger particles of oil shale in the adjacent first retort. During subsequent retorting operations in the fragmented mass within the first retort, the closure provided by the crushed oil shale particles inhibits gas flow from the fragmented mass in the first retort through the development drift to the adjacent second retort site.

Thermal expansion of the crushed oil shale particles can occur during retorting operations in the adjacent first retort, to further increase the resistance to gas flow from the fragmented mass in the first retort through the drift to the adjacent second retort site.

The crushed oil shale particles can be forced under pressure into the drift by pneumatic loading techniques. The crushed oil shale particles can be tightly compacted against the support provided by walls of unfragmented formation adjacent the drift so that the compacted particles completely fill the cross section of the drift, forming an effective means of inhibiting gas flow between adjacent retorts.

Such a closure between adjacent retorts can be formed economically, inasmuch as materials used to form the closure are already present at the retort site, and can be formed rapidly since crushing and pneumatic loading can be fast operations. The closure is reliable despite heating, deformation of adjacent unfragmented formation or nearby blasting. It can also minimize by-pass leakage through adjacent unfragmented formation.

DRAWINGS

These and other aspects of the invention will be more fully understood by referring to the following detailed description and the accompanying drawings in which.

DETAILED DESCRIPTION

The following detailed description is in two parts. In the first part, a system of retorts, and technique for forming such retorts, is described. In the second part, techniques are described for forming gas closures between the retorts according to principles of this invention.

Description of a Retort System

Figure 1:
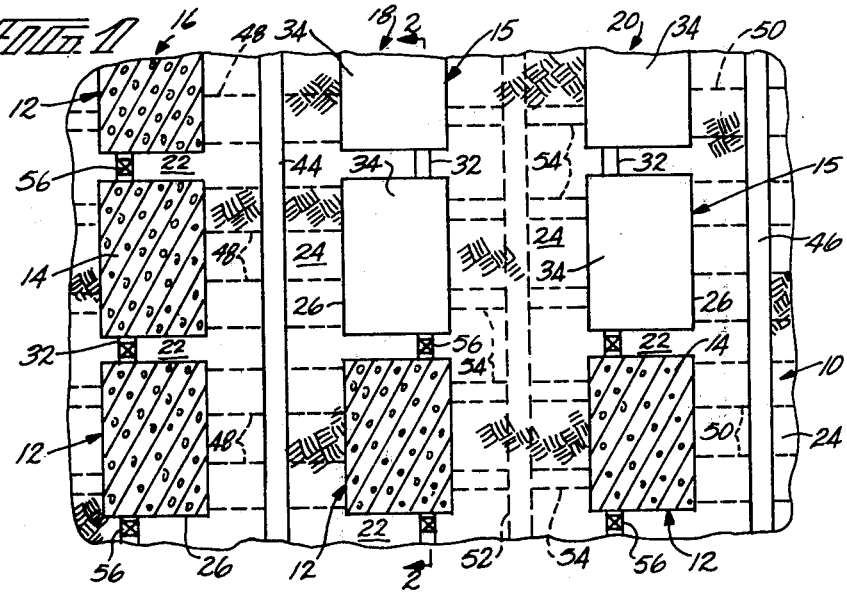
FIG. 1 is a fragmentary, semi-schematic cross sectional plan view, taken on line 1—1 of FIG. 2, illustrating a system of in situ oil shale retorts having closures for inhibiting gas flow in retort development drifts between adjacent retorts in accordance with the principles of this invention.

FIG. 1 is a plan view, in horizontal cross section, semi-schematically illustrating an in situ oil shale retort system formed in a subterranean formation 10 containing oil shale. The illustrated embodiment is a small area of an oil shale tract, indicating locations of several rows of in situ oil shale retorts 12 formed in the subterranean formation. The system of retorts is illustrated at different stages of development. The oil shale tract includes individual in situ oil shale retorts which, when completed by explosive expansion techniques, comprise a fragmented permeable mass 14 of formation particles containing oil shale. In preparing each retort for explosive expansion, formation from within the boundaries of each retort site is excavated to form at least one void, leaving a remaining portion of unfragmented formation within the boundaries of the retort site. The remaining portion of unfragmented formation is explosively expanded toward such a void to form the fragmented mass within the retort boundaries. Also illustrated are retort preparation regions of the oil shale tract where formation has been excavated from retort sites 15 under development prior to explosive expansion to form fragmented masses in the completed retorts. Excavation, explosive expansion, and production in retorting regions of the formation can occur essentially concurrently in various portions of the oil shale tract.

The in situ retorts are arranged in parallel rows 16, 18, 20 of retorts horizontally spaced apart substantially equidistantly from one another. The retorts within each row also are horizontally spaced apart substantially equidistantly from one another along the length of the row. In the illustrated embodiment, the retorts are generally rectangular in horizontal cross section, and the retorts are arranged in each row so the long dimensions of the retorts are aligned along the length of each row.

Vertically extending partitions or gas barriers 22 of unfragmented formation are left between the end boundaries of adjacent fragmented masses in each row of in situ retorts. Load-bearing barrier pillars 24 of unfragmented formation are interleaved between adjacent rows of retorts in the oil shale tract. The barrier pillars are shown generally uniform in width with respect to one another and are sufficiently wide to provide support for overburden above the upper boundaries of the retorts to minimize subsidence at the ground surface. The load-bearing pillars also act as gas barriers to isolate retorting operations in the fragmented masses within each row from retorting operations in adjacent rows. The narrow partitions of unfragmented formation 22, which separate the fragmented masses within each row, also can serve as a gas seal for isolating retorting operations in the fragmented masses within each row from one another. The partitions can be non-load bearing, i.e., they can be sufficiently thin that they do not provide significantly more support for overburden than the adjacent fragmented masses.

In the illustrated embodiment, which is but one example of possible arrangements of the in situ retort system, the retorts are relatively long and narrow, with dimensions that can be about 155 feet wide and 310 feet or more long. An exemplary height for such retorts is in the range of about 200 to 400 feet. The barrier pillars 24 of unfragmented formation which separate adjacent rows of retorts can be about 150 feet thick. The partitions or gas barriers 22 between adjacent retorts in each row can be about 50 feet thick, which provides adequate gas seals between retorts for isolating retorting operations. The dimensions in this embodiment are exemplary only and are set forth for the purpose of indicating principles of this invention.

Figure 2:
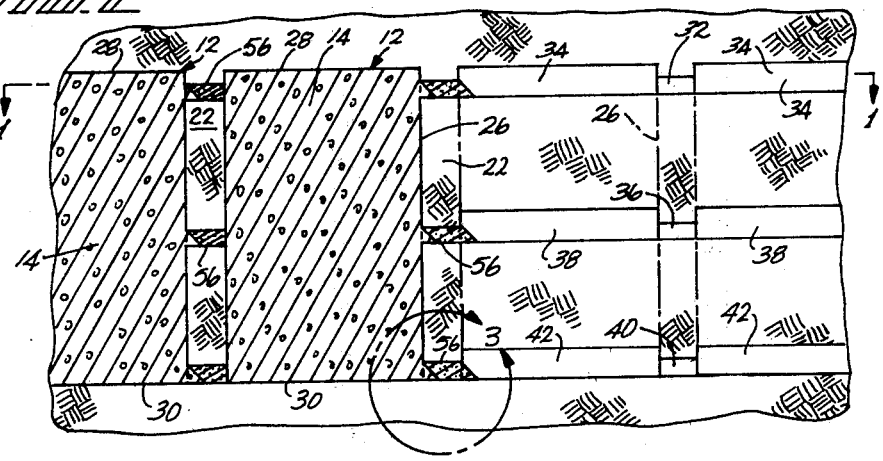
FIG. 2 is a fragmentary, semi-schematic vertical cross sectional view taken on line 2—2 of FIG. 1.

FIG. 2 is a vertical cross section of the retorts along line 2—2 of FIG. 1, with the cross section being taken through a series of retorts in a given row. The fragmented masses 14 are formed within vertical side boundaries 26 of each retort site. Each retort has a generally horizontal upper boundary 28 and a generally horizontal lower boundary 30. The upper and lower boundaries of retorts in adjacent rows generally lie within common upper and lower horizontal planes. In an alternative configuration, retorts in adjacent rows can have sloping lower boundaries with the lower boundaries of retorts in one row sloping downwardly toward retorts in an adjacent row, if desired.

The illustrated retort system is developed by a horizontal free face system in which upper, intermediate, and lower void spaces are excavated across upper, intermediate, and lower levels of each retort site. In such a horizontal free face system, a separate air level development drift 32 is excavated at an upper level along each row of retorts and through the respective retort sites within each row of retorts. The air level development drifts provide communication between peripheral air level drifts (not shown) at opposite ends of the rows of retorts and an upper level of the retort sites. If desired, a pair of spaced-apart and parallel air level development drifts can be excavated through the retort sites along each row, for example, although only one air level development drift per row of retorts is shown for simplicity. The development drifts at the air level provide access for excavating upper level void spaces 34 at an upper level within each retort site. The void spaces at the upper level extend across the entire horizontal cross section of the retort site.

Similarly, separate intermediate level development drifts 36 can be excavated along each row of retorts and through the respective retort sites in each row to provide communication between peripheral intermediate level drifts (not shown) and an intermediate level of the retorts. The intermediate development drifts provide access for excavating horizontally extending intermediate level void spaces 38 at the intermediate level within each retort site. Separate lower level development drifts 40 are excavated along each row of retorts and through the respective retort sites within each row to provide communication between peripheral production level drifts (not shown) and the lower level of the retorts within each row. The lower level development drifts provide access for excavating horizontally extending void spaces 42 at the lower level or production level within each retort site. As with the air level development drifts, only one intermediate level development drift and only one lower level development drift are shown per row of retorts, although more than one of such development drifts per row of retorts can be excavated at each level if desired. In addition to providing access to excavate void spaces at the different levels within each retort site, the development drifts also can be used to drill blasting holes into the retort volume and otherwise to assist in preparation of the retorts. Within each of the void spaces formed within each retort site, temporary roof supporting pillars (not shown) of unfragmented formation also can be left in place during mining operations.

The illustrated embodiment is a system of relatively taller retorts, say retorts approximately 400 feet in height, in which it is preferred to excavate intermediate level void spaces between the air level void spaces and the production level void spaces. Alternatively, for a system of relatively shorter retorts, say approximately 250 feet in height, excavation of void spaces at an intermediate level can be omitted.

Separate air level drifts are excavated at an upper level of the retorts between adjacent rows of retorts within alternating barrier pillars 24. In the illustrated embodiment, a first air level drift 44 is excavated within the barrier pillar between the first and second rows 16, 18 of retorts; and a second air level drift 46 is excavated within the barrier pillar between the third row 20 of retorts and a fourth row of retorts (not shown) along a side of the third row opposite from the second row of retorts. Each air level drift extends the length of the adjacent rows of retorts. Thus, the air level drifts extend parallel to one another across the retort tract. Each air level drift also is excavated approximately equidistantly from the retorts in the adjacent rows of retorts. Since the air level drifts are excavated only in every second barrier pillar, the intermediate support pillars are essentially intact at the air level.

Lateral air inlet passages, such as spaced-apart bore holes 48, are drilled outwardly from opposite sides of the first air level drift to the nearest upper edges of each retort in the first and second rows 16, 18 of retorts. Similar lateral air inlet passages or bore holes 50 are also drilled outwardly from opposite sides of the second air level drift 46 to the nearest upper edges of each retort in the third and fourth rows of retorts adjacent the second air level drift, etc. In the illustrated embodiment, only four of such bore holes are shown per retort for simplicity, but in practice, a larger number of such bore holes are preferably drilled from the air level drift into the upper edge of each retort. The lateral air inlet passages provide fluid communication between each air level drift and the adjacent upper edges of the retorts in the rows adjacent opposite sides of the drift. The bore holes are used for supplying air to the fragmented masses, at spaced-apart locations along the length of the fragmented masses, during a subsequent retorting operation in each fragmented mass.

Separate production level drifts are excavated at a lower production level of the retorts between rows of retorts in intervening barrier pillars 24 between the barrier pillars in which the air level drifts 44 are excavated. In the illustrated embodiment, a production level drift 52 is excavated between the second and third rows 18, 20 of retorts and extends along the length of the adjacent rows of retorts. The production level drift is excavated generally equidistantly from the second and third rows of retorts and is preferably excavated adjacent the bottom boundaries of the retorts in the adjacent rows, although such a production level drift also can be excavated at a level spaced below the bottom boundaries of the adjacent retorts, if desired. Other production level drifts in other barrier pillars are not shown in the drawings.

Lateral product withdrawal drifts 54 extend between the production level drift 52 and the nearest lower edge of each of the retorts in the second and third rows of retorts. A pair of parallel lateral product withdrawal drifts are shown extending from each retort to an adjacent production level drift, although a different number of such lateral drifts can be used at the production level, if desired. The lateral product withdrawal drifts provide access to a lower portion of each adjacent retort site for excavating formation for forming the lower void space within each retort volume. The lateral product withdrawal drifts also provide a means for withdrawing liquid and gaseous products of retorting from adjacent lower edges of retorts in the rows of retorts on opposite sides of each production level drift.

After the void spaces are excavated within each retort site at the air level, the intermediate level, and the production level, the remaining zones of unfragmented formation within such retort site are explosively expanded toward such voids to form the fragmented permeable mass 14 of formation particles containing oil shale within the boundaries of each retort. Temporary roof support pillars, if left in place during mining operations, are explosively expanded before the formation between the voids is explosively expanded. Explosive expansion of the pillars and the intervening zones of formation between the voids can be in a single round of explosions, or as a series of separate explosions.

During retorting operations, air or other oxygen-supplying gas is introduced to the upper edge of the fragmented mass in each retort from the adjacent air level drift via the air inlet passages. Formation particles at the top of the fragmented mass are ignited to establish a combustion zone at the top of the fragmented mass. The air or other oxygen-supplying gas introduced along the upper edge of the fragmented mass sustains the combustion zone in the fragmented mass and causes it to advance through the fragmented mass. Combustion gas produced in the combustion zone passes through the fragmented mass to establish a retorting zone on the advancing side of the combustion zone where kerogen in the fragmented mass is converted to liquid and gaseous products of retorting. Liquid products, namely, shale oil and water, and off gas produced during operation of each retort, are withdrawn from the fragmented mass through the lateral product withdrawal drifts at the lower edge of the retort opposite from the upper edge at which the air is received from the air level drift system. The gas flow through each fragmented mass is generally diagonally, from the upper edge of the retort toward the opposite lower edge of the retort. The shale oil, water, and off gas can be withdrawn separately from the production level drift and passed to above ground.

In one embodiment, explosive expansion operations for a given row of retorts are not started until excavation of the entire row of retort development drifts and voids is completed between the peripheral drifts at opposite ends of the row. This provides for effective circulation of ventilation air to all underground workings in the row during excavation operations.

It is desirable to blast in sequence so as to form one retort at a time in a given row, advancing from one end of the row to the other. FIGS. 1 and 2 illustrate such a procedure in which blasting advances one retort at a time along the length of each row of retorts.

Techniques for forming such retorts are more fully described in U.S. Pat. No. 4,133,580, which is incorporated herein by this reference.

Description of Closures for Retort Development Drifts

Following the explosive expansion step for forming each retort, gas barriers or closures 56 are formed in the upper, intermediate, and lower level retort development drifts. Such closures are formed between each previously-formed fragmented mass and the side boundary of the next retort being formed. The closures inhibit gas flow between adjacent retorts in each row during retorting operations so that operations within individual retorts can be controlled independently of retorting operations in adjacent retorts.

The explosive expansion step naturally forms a fragmented permeable mass 58 of oil shale particles (also referred to as a toe of oil shale rubble) in the retort development drift adjacent the fragmented mass just formed. The closures formed according to this invention are formed adjacent to each toe of oil shale rubble. By way of example, in a blasting technique advancing to the right in FIG. 2, the portion of each retort development drift on the right side of each fragmented mass has such a toe of oil shale rubble having a top surface or face 60 substantially at an angle of repose of such oil shale particles. Each toe of oil shale rubble completely covers the opening leading from the fragmented mass in the retort to the development drift leading away from the fragmented mass in the retort. If desired, additional fragmented formation particles can be added to the top of the mass of particles in the drift, or excess particles can be removed from the mass of particles present in the drift by conventional excavation techniques.

Figure 3:
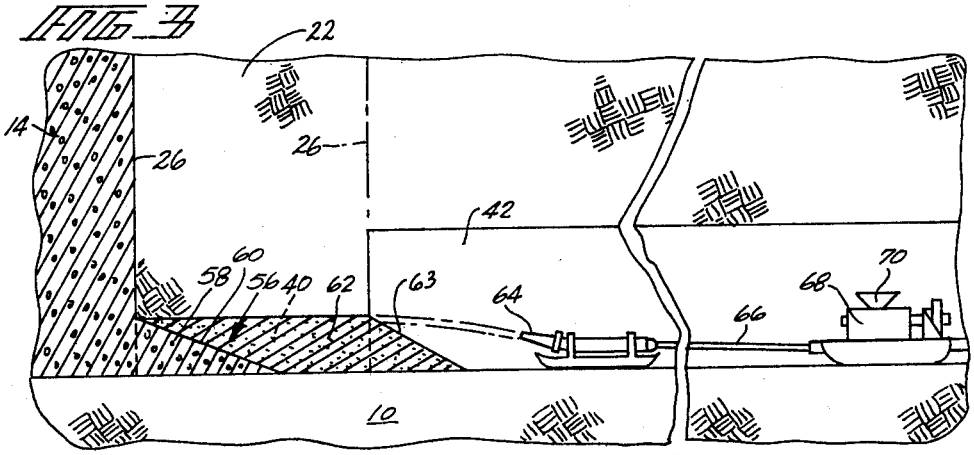
FIG. 3 is an enlarged schematic view in vertical cross section, illustrating techniques for forming a gas seal shown within the circle 3 of FIG. 2.

Each closure is formed by a mass 62 of crushed and/or screened oil shale particles loaded under pressure into the development drift so as to cover the exposed face 60 of the toe 58 of oil shale rubble present in the drift. The crushed and/or screened particles will be referred to below as "crushed oil shale particles" for simplicity. The crushed oil shale particles have an average particle size appreciably smaller than the average particle size of oil shale particles in the adjacent in situ retort. The retort development drift is filled with the crushed oil shale particles by blowing the particles into the drift toward the toe of oil shale rubble in the drift, to pack the crushed particles tightly against the face 60 of the toe of larger oil shale particles. Preferably, the crushed oil particles extend along the drift for a distance greater than the distance the mass of particles from the adjacent fragmented mass extend into the drift. The crushed oil shale particles are blown into the drift by pneumatic loading techniques. One example of a pneumatic loading system is illustrated in FIG. 3 in which crushed oil shale particles are blown under pressure through a nozzle 64 at the end of a pipeline or conveyor line 66 connected to a pneumatic feeder unit 68. Particles to be conveyed are fed into a hopper 70 on the pneumatic feeder unit. The pneumatic feeder can be a rotary air-lock device which introduces the crushed oil shale particles into a fast moving, low-pressure air stream. The pneumatic feeder is shown located in underground workings at the same level as the drift which is being filled, although in other instances the pneumatic feeder can be at the ground surface, and the crushed oil shale particles can be conveyed to the underground workings at the various retort levels by conveyor lines. A blower unit and power supply used in operating the pneumatic feeder unit are not shown in FIG. 3. An example of such a low-pressure pneumatic pipeline conveying system that can be used for pneumatically loading oil shale particles into the development drifts is manufactured by Radmark Engineering of North Vancouver, B.C., Canada.

Preferably, the drift closure consists essentially of the mass of crushed and/or screened oil shale particles. That is, the material used for forming such closure does not contain any significant amounts of other materials, such as cements, sand, etc., but consists principally of the oil shale particles naturally present at the site.

The crushed oil shale particles are packed tightly all the way to the top of the retort development drift to fill the entire vertical cross section of the drift with the crushed particles, and to fill a sufficient length of the drift with such particles, so that the entire face 60 of the larger particle size mass 58 of rubble in the drift is completely covered. The stationary toe of oil shale particles in the drift, and the rigidity of the walls of unfragmented formation adjacent the drift, both provide a solid means of support against which the crushed oil shale particles can be tightly compacted into the drift. Preferably, the entire length of the drift is filled with the compacted crushed oil shale particles. The face 63 of the mass of crushed oil shale particles can extend into the void space in an adjacent retort site without significant effect on subsequent explosive expansion of oil shale in that retort.

The mass of crushed particles packed into the drift between retorts preferably has an average void fraction less than average void fraction of the fragmented masses in the adjacent retorts. Pneumatic loading can produce densities in the packed mass of particles in the order of 90% or more of the density of unfragmented oil shale. That is, the closure can have a void fraction of 10% or less. This can be compared with the average void fraction in an in situ oil shale retort which can be in the range of from about 15 to 40% and preferably about 20 to 35%. The low void fraction in the closure cooperates with the small particle size to form a tight drift closure.

Dense packing in the drift closure is achieved by pneumatic loading of crushed oil shale particles having a range of particle sizes. The larger particles projected against the face of material as the mass in the drift accumulates provides compacting forces and smaller particles pack into the interstices between larger particles. The resultant low void fraction has a large influence on resistance to gas flow. The general formula for gas flow resistance is $$P = \frac{C(1-\epsilon)^2 V^2}{3}$$

where P is pressure drop through a unit mass, C is a constant, $\epsilon$ is the void fraction and V is the superficial gas velocity through the mass. Assuming a 20% void fraction in the fragmented mass in a retort, the unit pressure drop through the fragmented mass is about 80 $CV^2$. Assuming 10% void fraction in a drift closure, the unit pressure drop through the drift closure is 810 $CV^2$ or more than ten times greater for the same superficial gas velocity. The smaller particle size in the drift closure further increases gas flow resistance.

The resistance to gas flow through a fragmented mass of particles is generally inversely proportional to the particle size. The crushed oil shale particles produce a considerably greater resistance to gas flow than the relatively larger particle sizes in the fragmented mass of oil shale within the adjacent retort and in the toe of rubble in the drift. The packing of the crushed particles under pressure into the drift, against the rigid walls of unfragmented formation, further reduces the horizontal cross section for gas flow through the drift, as opposed to a loose layer of such particles which does not fill the drifts to roof, and thereby increases the resistance to gas flow provided by the closure of crushed oil shale particles. The closure of crushed oil shale particles is permeable, in the sense that an impermeable seal is not formed by the closure of crushed particles. It is not essential that a completely gas-tight seal be obtained, since adjacent retorts can be operated essentially simultaneously as part of a cluster of retorts, with the closures providing adequate means of inhibiting gas flow between adjacent retorts. The permeability of the crushed oil shale closure in the drift is much less than the permeability of the fragmented mass of particles in the retort. Further, the pressure difference between adjacent retorts during operation can be rather low. Hence, flow of gas through such a permeable closure can be quite low and have no appreciable effect on retorting.

Any heating of the material in the closure also tends to inhibit gas flow due to thermal expansion of the particles, adsorption of liquid on the surfaces of the particles, and thermal decrepitation which further reduces particle size. When, rich oil shale particles are used in the crushed oil shale closure, the high kerogen content enhances thermal expansion of the particles from the heat generated during retorting in the adjacent retorts. Crushed oil shale particles with an average kerogen content lower than the average kerogen content of the formation particles in the adjacent retort can be used since such material is less valuable for aboveground retorting than is rich oil shale.

The crushed oil shale particles preferably contain all size fractions of screened material up to a maximum particle size (diameter) of about two-thirds of the placing pipe diameter. In one embodiment, the inside diameter of the placing pipe used with the pneumatic loading system of FIG. 3 is about 10 inches. If desired, some of the finest particles in the crushed oil shale can be removed by screening for minimizing dust. Alternatively, or in addition, water can be added as the crushed oil shale is blown into the drift to minimize dusting. Such moistening can also reduce gas permeability through the closure.

In an exemplary embodiment, the weight average size of formation particles in the fragmented mass formed by explosive expansion can be two to three inches; that is, half of the weight of particles in the fragmented mass is in particles smaller than two to three inches, and the other half is in the form of particles larger than two to three inches. The crushed oil shale in the closure preferably has a maximum particle size of about three inches or less, hence, the weight average particle size is a fraction of an inch. For example, a drift closure can be formed with crushed oil shale particles where 30% by weight of the particles are smaller than $\frac{1}{8}$ inch. The permeability of the closure can be 10% or less of the permeability of the fragmented mass; that is, the gas flow resistance through a unit volume of the crushed formation in the drift is about 10 times the gas flow resistance of the fragmented mass in the retort.

A gas closure formed by pneumatically packing crushed oil shale particles into the drift is reliable because it is somewhat non-rigid. Thus, in the event of deformation of adjacent unfragmented formation, such as sagging of the roof of the drift, the compaction of the drift closure can increase, thereby providing even greater resistance to gas flow. The non-rigid closure is also quite resistant to damage during blasting or explosive expansion of adjacent retorts. Concrete or other rigid drift closures can be subject to damage during blasting. Another advantage of the drift closure is that gas leakage through adjacent unfragmented formation can also be reduced. Some gas can by-pass a drift closure through fissures in formation adjacent to the drift. A drift closure formed by packing the drift with crushed formation extends through a substantial length of the drift. Any by-passing gas therefore has a longer distance to travel through the unfragmented formation. The number of continuous gas flow paths can decrease and the flow resistance of such paths can increase as compared with by-passing a bulkhead, for example.

In another embodiment, the drift between retorts can be largely or completely filled with crushed formation particles before explosive expansion of formation in the interconnected retorts. Large explosions can be involved when forming an in situ oil shale retort, and substantial amounts of rubble can be ejected into adjacent drifts. This can reduce the void fraction in the fragmented mass near such a drift leading to nonuniform void fraction distribution and nonuniform gas flow through the fragmented mass during retorting. Ejection of rubble into the drift due to explosive expansion can be minimized by providing a relatively immovable mass of particles in the drift. In such an embodiment, a stout barrier, such as a wall of timbers, is erected in the drift adjacent the retort being formed. Crushed oil shale is then pneumatically piled in the drift against the barrier. The drift can be filled to the roof, as described above, or, if desired, a narrow passage can be left over the top of the pile of crushed oil shale to permit limited access into the retort site for final preparations for explosive expansion. When formation is explosively expanded to form the fragmented mass in the retort, some of the crushed oil shale may be moved, but ejection of formation into the drift can be largely prevented. Additional crushed formation can be pneumatically placed in the drift following explosive expansion to complete filling and/or replacing crushed formation moved during explosive expansion.

The crushed oil shale particles thus provide an effective means of closing off development drifts between adjacent retorts. Several of such development drifts can extend between each pair of adjacent retorts within a cluster of retorts, and, therefore, a large number of gas closures can be required for a system of retorts. The fine particle size closure provides an economical means for inhibiting gas flow through the drifts between adjacent retorts in such a system of retorts. Such a closure between adjacent retorts is formed economically and rapidly with materials already present at the retort site.

What is claimed is:

1. A method for recovering liquid and gaseous products from a system of in situ oil shale retorts formed in a subterranean formation containing oil shale, such an in situ oil shale retort having upper, lower, and side boundaries of unfragmented formation and containing a fragmented permeable mass of formation particles containing oil shale, the method comprising the steps of:

excavating at least one void within the boundaries of a first in situ retort site, leaving a zone of unfragmented formation within the boundaries of the first retort site;

excavating at least one retort development drift between such a void and a second in situ retort site adjacent the first in situ retort site;

explosively expanding such a zone of unfragmented formation toward such a void within the first retort site for forming a first in situ oil shale retort containing a fragmented permeable mass of formation particles containing oil shale and a mass of such formation particles in the retort development drift adjacent the first retort;

pneumatically compacting a permeable mass of crushed oil shale particles into the development drift against the fragmented mass of particles in the drift, said crushed particles having an average particle size smaller than the average particle size of the particles in the fragmented mass in the first retort for providing a greater resistance to gas flow than the relatively larger particles sizes of the formation particles in the first retort for inhibiting gas flow through the development drift between the fragmented mass in the first retort and the second retort site;

establishing a combustion zone within the fragmented mass in the first retort and introducing an oxygen-supplying gas to such fragmented mass for advancing the combustion zone through the fragmented mass and establishing a retorting zone on the advancing side of the combustion zone for producing liquid and gaseous products of retorting in the first retort, the mass of crushed oil shale particles inhibiting flow of gaseous products through the development drift between the first retort and the second retort site; and withdrawing the liquid and gaseous products of retorting from a lower portion of the fragmented mass in the first retort.

2. The method according to claim 1 in which the crushed oil shale particles have a lower average void fraction than the average void fraction of the fragmented mass of particles within the first retort.

3. A method for recovering liquid and gaseous products from a system of in situ oil shale retorts formed in a subterranean formation containing oil shale, such as in situ oil shale retort having upper, lower, and side boundaries of unfragmented formation and containing a fragmented permeable mass of formation particles containing oil shale, the method comprising the steps of:

excavating at least one retort development drift between the boundaries of a first in situ oil shale retort site and the boundaries of a second in situ oil shale retort site located adjacent the first retort site; and pneumatically compacting crushed formation particles into the drift, the weight average particle size of the crushed formation particles being less than the weight average particle size of formation particles in the fragmented masses in the retort sites.

4. The method according to claim 3 comprising pneumatically compacting the crushed formation particles into the drift after forming the fragmented mass in the first retort site.

5. The method according to claim 3 comprising pneumatically compacting into the drift formation particles having a lower void fraction than the average void fraction of particles in the fragmented masses in the retorts.

6. A method for inhibiting gas flow through a drift interconnecting first and second in situ oil shale retorts in a subterranean formation containing oil shale, each of said retorts containing a fragmented permeable mass of formation particles containing oil shale, the drift extending through unfragmented formation between the fragmented masses in the first and second retorts, the method comprising filling the drift between the retorts by pneumatically compacting crushed formation particles into the drifts, the crushed particles having a weight average particle size smaller than the weight average particle size of formation particles in the fragmented masses in the retorts.

7. The method according to claim 6 comprising filling the drift with crushed formation particles containing oil shale.

8. The method according to claim 6 comprising filling the drift after forming the fragmented mass in the first retort.

9. The method according to claim 6 comprising filling the drift with formation particles having a lower void fraction than the average void fraction of formation particles in the fragmented masses in the retorts.

10. A method for inhibiting gas flow through a retort development drift adjacent a fragmented permeable mass of formation particles in an in situ retort formed in a subterranean formation, the retort development drift being bounded by walls of unfragmented formation, the method comprising the steps of:

forming a fragmented permeable mass of formation particles in the in situ retort, wherein a portion of the fragmented mass has an exposed face extending into the retort development drift, the mass of formation particles in the drift having substantially the same average particle size as the particles in the retort; and forming in said drift a closure consisting essentially of a fragmented permeable mass of crushed formation particles having a smaller average particle size than the average particle size of the particles in the fragmented mass within the retort, the mass of crushed formation particles being pneumatically loaded into the drift against said exposed face of the fragmented permeable mass of formation particles extending into the drift and against the walls of unfragmented formation bounding the drift so as to occupy substantially the entire cross section of the drift to thereby form said closure with a greater resistance to gas flow than the fragmented permeable mass of particles within the retort for inhibiting gas flow from the fragmented mass through the closure formed in the retort development drift.

11. The method according to claim 10 wherein the formation particles contain oil shale and including forming the closure from crushed oil shale particles having a higher average kerogen content than the average kerogen content of the particles within the fragmented mass in the adjacent retort.

12. A method for inhibiting gas flow through a retort development drift in gas communication with an adjacent fragmented permeable mass of formation particles containing oil shale formed within an in situ oil shale retort site in a subterranean formation containing oil shale, comprising the steps of:

explosively expanding formation within the retort site toward a void space in said retort site to form the fragmented mass within the retort site and a mass of formation particles within the retort development drift; and pneumatically loading crushed oil shale particles against the mass of formation particles within the retort development drift and against walls of unfragmented formation bounding the drift, the crushed oil shale particles having an average particle size smaller than the average particle size of the formation particles in the in situ retort, the crushed oil shale particles being packed within the drift so as to occupy substantially the entire cross section of the drift for providing a greater resistance to gas flow than the relatively larger particles in the in situ retort for inhibiting gas flow through the retort development drift.

13. The method according to claim 12 including packing the crushed oil shale particles along the length of the drift for a distance greater than the distance that the mass of formation particles extends into the drift.

14. A method for inhibiting gas flow through a retort development drift adjacent a fragmented permeable mass of formation particles containing oil shale in an in situ oil shale retort formed within a subterranean formation containing oil shale, comprising the steps of:

forming a permeable mass of crushed oil shale particles within the retort development drift and against walls of unfragmented formation bounding the drift, the crushed oil shale particles having an average particle size smaller than the average particle size of the particles in the adjacent retort for providing a greater resistance to gas flow than the relatively larger particle sizes of the formation particles within the fragmented mass in the retort for inhibiting gas flow between the fragmented mass and the retort development drift; and retorting oil shale within the fragmented mass in the retort to produce liquid and gaseous products of retorting, heat from such retorting contacting at least a portion of the crushed oil shale particles in the drift, the crushed oil shale particles having a higher kerogen content than the average kerogen content of formation particles in the fragmented mass for enhancing thermal expansion of the crushed oil shale particles during such retorting operations to further increase the resistance to gas flow through the retort development drift.

15. The method according to claim 14 including compacting the mass of crushed oil shale particles into the drift so the crushed particles occupy substantially the entire cross section of the drift.

16. The method acording to claim 14 including compacting the mass of crushed oil shale particles into the drift so the mass of crushed oil shale particles has a void fraction less than the average void fraction of the fragmented mass in the retort.

17. A method for forming a gas seal in a retort development drift adjacent a fragmented permeable mass of formation particles in an in situ oil shale retort in a subterranean formation containing oil shale, comprising the steps of:

excavating at least one void within the boundaries of an in situ oil shale retort site, leaving a zone of unfragmented formation within the boundaries of the retort site;

explosively expanding such a zone of unfragmented formation toward such a void for forming a fragmented permeable mass of formation particles containing oil shale within the retort site and a mass of such formation particles in the retort development drift;

pneumatically loading crushed oil shale particles against the formation particles within the retort development drift and against walls of unfragmented formation adjacent the drift so that the crushed oil shale particles close off substantially the entire cross section of the retort development drift, the crushed oil shale particles having a smaller average particle size than the average particle size of the formation particles in the adjacent retort for providing a greater resistance to gas flow than the relatively larger formation particles within the fragmented mass; and establishing a combustion zone within the fragmented mass and introducing an oxygen supplying gas to the fragmented mass and establishing a retorting zone on the advancing side of the combustion zone for producing liquid and gaseous products of retorting within the fragmented mass, heat from such retorting contacting the crushed oil shale particles in the development drift, thereby producing thermal expansion of the crushed particles from the heat generated during retorting to further increase the resistance to gas flow through the retort development drift.

18. The method according to claim 17 including pneumatically loading the crushed oil shale particles into the drift.

19. The method according to claim 17 including closing off the drift with a mass of particles consisting essentially of said crushed oil shale particles.

20. The method according to claim 17 wherein the oil shale particles in the drift have a lower void fraction than the average void fraction of the fragmented mass in the retort.

21. A method for recovering liquid and gaseous products from a system of in situ oil shale retorts formed in a subterranean formation containing oil shale, such an in situ oil shale retort having upper, lower, and side boundaries of unfragmented formation and containing a fragmented permeable mass of formation particles containing oil shale, the method comprising the steps of:

excavating at least one void within the boundaries of a first in situ retort site, leaving a zone of unfragmented formation within the boundaries of the first retort site;

excavating at least one retort development drift between such a void and a second in situ retort site adjacent the first in situ retort site;

explosively expanding such a zone of unfragmented formation toward such a void within the first retort site for forming a first in situ oil shale retort containing a fragmented permeable mass of formation particles containing oil shale and a mass of such formation particles in the retort development drift adjacent the first retort;

pneumatically compacting a permeable mass of crushed oil shale particles into the development drift against the fragmented mass of particles in the drift, said mass of crushed particles having a void fraction less than the average void fraction of the fragmented mass in the first retort for providing a greater resistance to gas flow than the fragmented mass in the first retort for inhibiting gas flow through the development drift between the fragmented mass in the first retort and the second retort site;

establishing a combustion zone within the fragmented mass in the first retort and introducing an oxygen-supplying gas to such fragmented mass for advancing the combustion zone through the fragmented mass and establishing a retorting zone on the advancing side of the combustion zone for producing liquid and gaseous products of retorting in the first retort, the mass of crushed oil shale particles inhibiting flow of gaseous products through the development drift between the first retort and the second retort site; and withdrawing the liquid and gaseous products of retorting from a lower portion of the fragmented mass in the first retort.

22. A method for inhibiting gas flow within a system of in situ oil shale retorts formed in a subterranean formation containing oil shale, each such in situ oil shale retort having upper, lower, and side boundaries of unfragmented formation and containing a fragmented permeable mass of formation particles containing oil shale, the method comprising the steps of:

excavating at least one retort development drift between the boundaries of a first in situ oil shale retort site and the boundaries of a second in situ oil shale retort site located adjacent the first retort site; and pneumatically compacting crushed formation particles into the drift, the void fraction of the compacted crushed formation particles being less than the average void fraction of the fragmented masses in the retort sites.

23. The method according to claim 22 comprising pneumatically compacting the crushed formation particles into the drift after forming the fragmented mass in the first retort site.

24. A method for inhibiting gas flow through a drift interconnecting first and second in situ oil shale retorts in a subterranean formation containing oil shale, each of said retorts containing a fragmented permeable mass of formation particles containing oil shale, the drift extending through unfragmented formation between the fragmented masses in the first and second retorts, the method comprising filling the drift between the retorts by pneumatically compacting crushed formation particles into the drift, the formation particles having a void fraction smaller than the average void fraction of the fragmented masses in the retorts.

25. The method according to claim 24 comprising filling the drift with crushed formation particles containing oil shale.

26. The method according to claim 24 comprising filling the drift after forming the fragmented mass in the first retort.

27. A method for inhibiting gas flow through a retort development drift adjacent a fragmented permeable mass of formation particles in an in situ retort formed in a subterranean formation, the retort development drift being bounded by walls of unfragmented formation, the method comprising the steps of:

forming a fragmented permeable mass of formation particles in the in situ retort, wherein a portion of the fragmented mass has an exposed face extending into the retort development drift; and forming in said drift a closure consisting essentially of a fragmented permeable mass of crushed formation particles having a smaller average void fraction than the average void fraction of the fragmented mass within the retort, the mass of crushed formation particles being pneumatically compacted into the drift against said exposed face of the fragmented permeable mass of formation particles extending into the drift and against the walls of unfragmented formation bounding the drift so as to occupy substantially the entire cross section of the drift to thereby form said closure with a greater resistance to gas flow than the fragmented permeable mass of particles within the retort for inhibiting gas flow from the fragmented mass through the closure formed in the retort development drift.

28. The method according to claim 27 wherein the formation particles contain oil shale and including forming the closure from crushed oil shale particles having a higher average kerogen content than the average kerogen content of the particles within the fragmented mass in the adjacent retort.

29. A method for forming a gas seal in a retort development drift adjacent a fragmented permeable mass of formation particles in an in situ oil shale retort in a subterranean formation containing oil shale, comprising the steps of:

excavating at least one void within the boundaries of an in situ oil shale retort site, leaving a zone of unfragmented formation within the boundaries of the retort site;

explosively expanding such a zone of unfragmented formation toward such a void for forming a fragmented permeable mass of formation particles containing oil shale within the retort site and a mass of such formation particles in the retort development drift;

pneumatically loading crushed oil shale particles against the formation particles within the retort development drift and against walls of unfragmented formation adjacent the drift so that the crushed oil shale particles close off substantially the entire cross section of the retort development drift, the crushed oil shale particles having a smaller average void fraction than the average void fraction of the fragmented mass in the adjacent retort for providing a greater resistance to gas flow than the fragmented mass; and establishing a combustion zone within the fragmented mass and introducing an oxygen-supplying gas to the fragmented mass and establishing a retorting zone on the advancing side of the combustion zone for producing liquid and gaseous products of retorting within the fragmented mass, heat from such retorting contacting the crushed oil shale particles in the development drift, thereby producing thermal expansion of the crushed particles from the heat generated during retorting to further increase the resistance to gas flow through the retort development drift.

30. The method according to claim 29 including closing off the drift with a mass of particles consisting essentially of said crushed oil shale particles.

31. A method for inhibiting gas flow through a retort development drift adjacent a fragmented permeable mass of formation particles in an in situ retort formed in a subterranean formation, the retort development drift being bounded by walls of unfragmented formation, the method comprising the steps of:

forming a fragmented permeable mass of formation particles in the in situ retort, wherein a portion of the fragmented mass has an exposed face extending into the retort development drift, the mass of formation particles in the drift having substantially the same average particle size as the particles in the retort; and forming in said drift a closure consisting essentially of a fragmented permeable mass of crushed formation particles containing oil shale and having a higher average kerogen content than the average kerogen content of the particles within the fragmented mass in the adjacent retort, said crushed formation particles having a smaller average particle size than the average particle size of the particles in the fragmented mass within the retort, the mass of crushed formation particles being compacted against said exposed face of the fragmented permeable mass of formation particles extending into the drift and against the walls of unfragmented formation bounding the drift so as to occupy substantially the entire cross section of the drift to thereby form said closure with a greater resistance to gas flow than the fragmented permeable mass of particles within the retort for inhibiting gas flow from the fragmented mass through the closure formed in the retort development drift.

32. A method for inhibiting gas flow through a retort development drift adjacent a fragmented permeable mass of formation particles in an in situ retort formed in a subterranean formation, the retort development drift being bounded by walls of unfragmented formation, the method comprising the steps of:

forming a fragmented permeable mass of formation particles in the in situ retort, wherein a portion of the fragmented mass has an exposed face extending into the retort development drift; and forming in said drift a closure consisting essentially of a fragmented permeable mass of crushed formation particles containing oil shale and having a higher average kerogen content than the average kerogen content of the particles within the fragmented mass in the adjacent retort, the crushed formation particles having a smaller average void fraction than the average void fraction of the fragmented mass within the retort, the mass of crushed formation particles being compacted against said exposed face of the fragmented permeable mass of formation particles extend into the drift and against the walls of unfragmented formation bounding the drift so as to occupy substantially the entire cross section of the drift to thereby from said closure with a greater resistance to gas flow than the fragmented permeable mass of particles within the retort for inhibiting gas flow from the fragmented mass through the closure formed in the retort development drift.

33. A method for inhibiting gas flow within a system of in situ oil shale retorts formed in a subterranean formation containing oil shale, each such in situ oil shale retort having upper, lower, and side boundaries of unfragmented formation and containing a fragmented permeable mass of formation particles containing oil shale, the method comprising the steps of:

excavating at least one retort development drift between the boundaries of a first in situ oil shale retort site and the boundaries of a second in situ oil shale retort site located adjacent the first retort site; and loading crushed formation particles containing oil shale into the drift for occupying substantially the entire cross section of the drift to thereby form a closure with a greater resistance to gas flow than the fragmented permeable mass of particles within the retort for inhibiting gas flow from the fragmented mass through the closure formed in the retort development drift, the crushed formation particles having a smaller average particle size than the average particle size of the particles in the fragmented mass within the retort, the crushed formation particles also having a higher average kerogen content than the average kerogen content of the particles within the fragmented mass in the adjacent retort.

34. A method for inhibiting gas flow within a system of in situ oil shale retorts formed in a subterranean formation containing oil shale, each in situ oil shale retort having upper, lower, and side boundaries of unfragmented formation and containing a fragmented permeable mass of formation particles containing oil shale, the method comprising the steps of:

excavating at least one void within the boundaries of a first in situ retort site, leaving a zone of unfragmented formation within the boundaries of the first retort site;

excavating at least one retort development drift between such a void and a second in situ retort site adjacent the first in situ retort site;

explosively expanding such a zone of unfragmented formation toward the void within the first retort site for forming a first in situ oil shale retort containing a fragmented permeable mass of formation particles containing oil shale and a mass of such formation particles in the retort development drift adjacent the first fragmented mass in the retort; and covering the mass of formation particles in the retort development drift by pneumatically loading a mass of smaller particle size particles into the drift and against the walls of unfragmented formation adjacent the drift so that the smaller particles close off substantially the cross section of the drift, the smaller particles having an average particle size smaller than the average particle size of the formation particles in the adjacent retort for providing a greater resistance to gas flow through the drift than the relatively larger formation particles within the fragmented mass.

35. A method for inhibiting gas flow within a system of in situ oil shale retorts formed in subterranean formation containing oil shale, each in situ oil shale retort having upper, lower, and side boundaries of unfragmented formation and containing a fragmented permeable mass of formation particles containing oil shale, the method comprising the steps of:

excavating at least one retort development drift interconnecting a boundary of a first in situ oil shale retort site and a boundary of a second in situ oil shale retort site located adjacent the first retort site, wherein a mass of formation particles containing oil shale is left in the retort development drift adjacent the boundary of the first retort site; and covering the mass of formation particles in the retort development drift by pneumatically loading a mass of smaller particle size particles into the drift, said smaller particles having an average particle size smaller than the average particle size of the formation particles in the drift, the smaller particles being pneumatically loaded into the drift for closing off the cross section of the drift so the mass of smaller particles provides a greater resistance to gas flow through the drift than the relatively larger formation particles in the drift.

* * * * *

UNITED STATES PATENT AND TRADEMARK OFFICE

CERTIFICATE OF CORRECTION

PATENT NO. : 4,441,760

DATED : April 10, 1984

INVENTOR(S) : Alex Hines

It is certified that error appears in the above-identified patent and that said Letters Patent is hereby corrected as shown below:

At the beginning of the specification, insert "The Government of the United States of America has rights in this invention pursuant to Cooperative Agreement DE-FC20-78LC10036 awarded by the U.S. Department of Energy."

Signed and Sealed this

*Sixteenth* Day of *September 1986*

[SEAL]

*Attest:*

DONALD J. QUIGG

*Attesting Officer*

*Commissioner of Patents and Trademarks*